United States Patent [19]

Henkin et al.

[11] Patent Number: 4,689,839

[45] Date of Patent: Sep. 1, 1987

[54] TAP WATER POWERED HYDROTHERAPY METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 902,179

[22] Filed: Aug. 29, 1986

Related U.S. Application Data

[63] Continuation-in-part of Ser. No. 796,987, Nov. 12, 1985, and Ser. No. 843,151, Mar. 24, 1986.

[51] Int. Cl.[4] ..... A61H 33/02

[52] U.S. Cl. ..... 4/542; 4/541; 4/544; 4/492; 128/66; 239/416.4; 239/416.5

[58] Field of Search ..... 4/541, 542, 492, 543–544, 4/491; 128/66; 239/428.5, 587, 429, 416.5, 413, 416, 416.4

[56] References Cited

U.S. PATENT DOCUMENTS

| | | | |
|---|---|---|---|
| 4,220,145 | 9/1980 | Stamp et al. | 4/542 |
| 4,335,854 | 6/1982 | Reynose | 4/542 X |
| 4,339,833 | 7/1982 | Mandell | 4/542 |
| 4,466,141 | 8/1984 | Starkey | 4/542 X |
| 4,520,514 | 6/1985 | Johnson | 4/542 X |
| 4,523,340 | 6/1985 | Watkins | 4/542 |

*Primary Examiner*—Henry K. Artis

*Attorney, Agent, or Firm*—Freilich, Hornbaker, Rosen & Fernandez

[57] ABSTRACT

A hydrotherapy apparatus for using available tap water supply pressure to mix fresh tap water, tub water, and air to discharge a water-air stream into a tub below the water surface. Energy derived from the tap water supply is used to concurrently translate a discharge nozzle along a path substantially transverse to the stream discharged from the nozzle.

55 Claims, 15 Drawing Figures

TAP WATER POWERED HYDROTHERAPY METHOD AND APPARATUS

RELATED APPLICATIONS

This is a continuation-in-part of U.S. patent application Ser. No. 796,987 filed Nov. 12, 1985 and U.S. patent application Ser. No. 843,151 filed Mar. 24, 1986, which are, by reference, incorporated herein.

BACKGROUND OF THE INVENTION

This invention relates generally to hydrotherapy and more particularly to a method and apparatus useful in spas, hot tubs, bathtubs and the like (hereinafter, "water tubs") for discharging a water-air stream to impact against and massage a user's body. Application Ser. No. 796,987 filed Nov. 12, 1985, discloses a hydrotherapy unit including a discharge nozzle mounted for translation along a two-dimensional path so as to cause the impacting fluid stream to sweep over an area of the user's body. Application Ser. No. 843,151 filed Mar. 24, 1986, discloses improved hydrotherapy embodiments for translating the discharge nozzle along a substantially random two-dimensional path.

Whereas the aforementioned applications discuss the use of electric pumps to power the disclosed hydrotherapy units, the present invention is primarily directed to a system which derives energy from a tap water supply to power hydrotherapy units, similar to those disclosed in the aforecited applications.

Exemplary hydrotherapy devices for massaging a user's body by moving a discharge nozzle are disclosed in U.S. Pat. Nos. 4,523,340; 4,339,833; 4,220,145; and 3,868,949. Other exemplary hydrotherapy devices for discharging water-air streams are disclosed in the following U.S. Pat. Nos. 4,502,168; 4,262,371; 3,905,358; and 3,297,025.

Other systems useful in water tubs for discharging water-air streams, including some systems supplied by a tap water supply source, are disclosed in the following U.S. Pats. Nos. 4,525,881; 4,502,168; 4,422,191; 4,340,039; 3,805,772; 3,745,994; 3,742,521; 3,736,924; 3,717,142; 3,587,976; 3,541,616; 3,528,411; 3,345,982; 3,340,870; 3,325,829; 3,319,266; 3,297,025; 3,271,790; 3,204,254; and 1,526,179.

Modern bathtub installations frequently include one or more jets mounted in the tub wall for discharging a water-air stream for impacting against the body of a user. Although most such installations include an electric pump for supplying recirculated tub water to the jets, the prior art (e.g. U.S. Pat. No. 3,742,521) does teach systems which avoid the use of electric pumps by using pressurized tap water to produce and discharge a combined flow of fresh water, air, and recirculated tub water.

SUMMARY OF THE INVENTION

The present invention relates to improvements in hydrotherapy and more particularly to a method and apparatus for using available tap water supply pressure to mix fresh tap water, tub water, and air to discharge a water-air stream into a tub below the water surface. In accordance with a preferred embodiment, energy derived from the tap water supply is additionally used to concurrently translate a discharge nozzle along a path substantially transverse to the stream discharged from the nozzle.

Systems implemented in accordance with the present invention preferably include at least one jet pump for entraining tub water in the fresh tap water flow supplied to the pump. The combined tap-tub water flow is then mixed with air to form a water-air stream prior to being discharged into the tub. Systems in accordance with the invention preferably include multiple hydrotherapy units, each including a discharge nozzle, which may either be fixedly mounted or mounted for movement substantially transverse to the stream discharged therefrom.

In an exemplary system installed in a bathtub, a first moving nozzle unit can be installed in a tub first endwall to discharge a stream for massaging a user's back while a second moving nozzle unit can be installed in the opposite end wall to discharge a stream for massaging a user's feet. Additional units having fixed or moving nozzles can be installed in the tub sidewalls.

Hydrotherapy units in accordance with the present invention preferably each include a jet pump for producing the aforementioned discharge stream. Each jet pump is comprised of a driving nozzle through which fresh tap water is supplied. The driving nozzle exits into a suction chamber having a suction inlet in communication with the tub water. The tap water entrains the tub water and the mixture then flows through a mixing tube into a second chamber having a suction inlet open to the air. The tap-tub water flow entrains the air to produce a water-air stream for discharge through a discharge nozzle into the tub. The discharge nozzle can either be fixedly mounted or mounted for movement along a path oriented substantially perpendicular to the discharged stream. The moving nozzle units can, for example, be of the type disclosed to applicants aforementioned applications.

Although embodiments of the invention can operate satisfactorily over a very wide range of tap water pressures, preferred embodiments are designed to operate most effectively with tap water pressure delivered to the jet pump of between about 30 PSI and 65 PSI. Preferred embodiments of the invention are designed so that the amount of fresh water supplied to the jet pump aspirates a much greater amount of tub water. Typically, $\frac{2}{3}$ to 4/5 of the water discharged from the discharge nozzle will be water captured from the tub for recirculation. This allows embodiments of the invention to consume relatively small amounts of water, e.g. 3.5 gallons per minute. Although this water consumption exceeds that used in conventional systems powered by electric pumps, the difference is not as great as it first seems. In the typical use of conventional jet tubs, the continual recirculation of the water cools the water in the tub and as a result the user has to frequently add hot water. In the typical use of embodiments of the present invention, warm tap water is supplied to the jet pump so that the discharge stream maintains the elevated temperature of the tub water. Excess water, of course, escapes through a conventionally provided overflow drain. A significant advantage of embodiments of the invention is that the need for an electric pump and related electrical components is eliminated. As a consequence, equipment and installation costs are considerably reduced and safety and reliability are enhanced.

In accordance with the preferred embodiment, a particularly efficient jet pump is utilized comprised of a straight, relatively long, mixing tube of substantially uniform diameter having a length about seven times its diameter (typically about $\frac{3}{8}$"). The exit diameter of the jet pump driving nozzle is preferably about one third of the mixing tube diameter and the distance from the driving nozzle exit to the mixing tube extrance is approximately three times the driving nozzle exit diameter. A curved flow tube couples the downstream end of the mixing tube to the discharge nozzle.

In a preferred installation in a water tub, the tub water suction inlet to each jet pump is positioned below the tub water line defined by the lever of the tub overflow drain inlet. The air suction inlet associated with each jet pump derives air from a port positioned above the water line. The nozzle for discharging the water-air stream into the tub, whether in a fixed nozzle or moving nozzle unit, is spaced below the tub water suction inlet to assure that whenever tub water is being aspirated, the stream will be discharged into the water pool, i.e. below the water surface, to minimize splashing out of the tub. If tub water is not being aspirated, the fresh water flow out of the discharge nozzle will be sufficiently small that splashing will not be a problem.

In accordance with further aspects of a preferred bathtub installation, the existing hot and cold water supply lines, controlled by conventional hot and cold water valves, are used to supply a pipe coupled to a selector and flow control valve. The selector/flow control valve enables a user to direct the supplied water flow either to the hydrotherapy units of the present invention or to the conventionally provided shower head and bathtub spout. The valve also enables the user to readily adjust the flow to the hydrotherapy units. An anti-siphon valve is preferably provided between the selector/flow control valve and the hydrotherapy units to prevent tub water from being sucked back into the supply lines in the event of a pressure drop.

DETAILED DESCRIPTION

Figure 1:
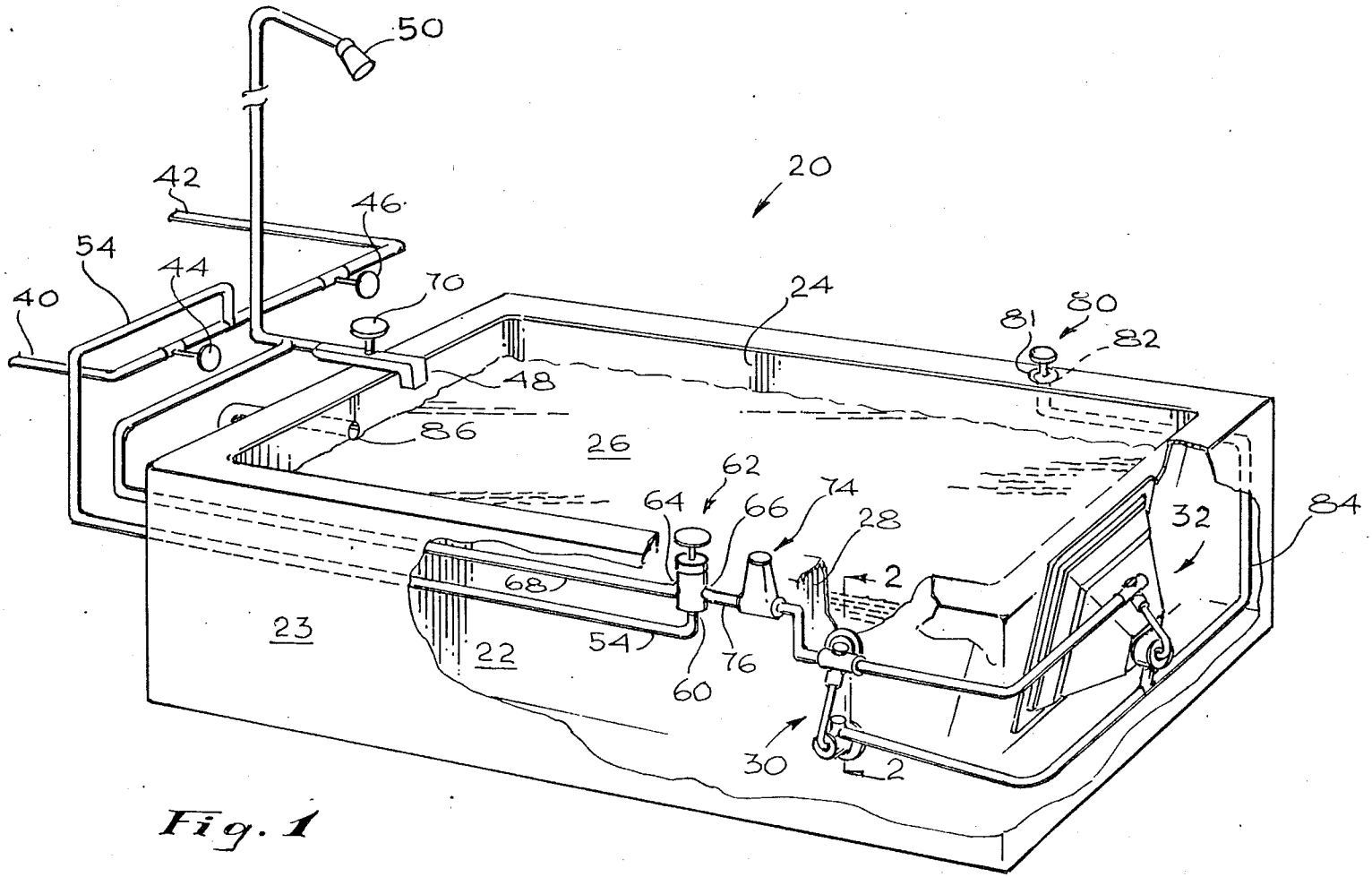
FIG. 1 is an isometric view, partially broken away, showing an exemplary bathtub installation of a hydrotherapy system in accordance with the present invention including a moving nozzle hydrotherapy unit and a fixed nozzle hydrotherapy unit.

Attention is initially directed to FIG. 1 which depicts a preferred embodiment of the invention installed in a water tub 20. Although the water tub 20 depicted in FIG. 1 is of a size and shape commonly referred to as a bathtub, it is pointed out that embodiments of the invention are useful not only in bathtubs, but also in a variety of other water tubs variously referred to as spa tubs, hot tubs, etc. Thus, it should be understood that the term "water tub" as used hereinafter is intended to encompass all forms of tubs capable of containing a water pool and suitable for enabling a user to partially or fully immerse his body in the water pool.

The water tub 20 defines an inner peripheral wall 22 and an outer peripheral wall 23. The inner wall 22 has an inner wall surface 24 which contacts and contains a water pool 26, and an outer wall surface 28 spaced from the peripheral 23.

In accordance with the invention, one or more hydrotherapy massage units are mounted between the peripheral walls 22, 23 for discharging a water stream through an opening in wall 22 into the water pool 26 for massaging the body of a user. These hydrotherapy massage units can include a fixed discharge nozzle unit 30, to be discussed in detail in connection with FIG. 2 hereinafter, and a moving discharge nozzle unit 32, to be discussed in detail hereinafter in connection with FIGS. 3–10. These hydrotherapy massage units can be installed at various locations along the peripheral wall 22 depending upon the exact shape and dimensions of the water tub 20. As depicted in FIG. 1, the unit 32 is placed to discharge a stream primarily for massaging a user's back. The unit 30, as shown, discharges a stream which will impact the user's back closer to his side. It should be understood that the location of the units 30, 32, as depicted in FIG. 1, is exemplary only and that the units can be installed at various locations along the tub peripheral wall, as for example in the floor portion of the peripheral wall 22 for massaging a user's feet and legs.

In accordance with a significant aspect of the invention, the hydrotherapy massage units 30, 32 are driven by an available pressurized tap water supply, instead of by an electrically driven pump. FIG. 1 illustrates a typical plumbing arrangement utilized when hydrotherapy massage units in accordance with the invention are installed in an otherwise substantially conventional bathtub configuration.

More specifically, FIG. 1 depicts conventional hot and cold water supply pipes 40 and 42. Pipes 40 and 42 are intended to represent the pipes typically available in a residential or commercial structure for supplying water to a conventional bathtub. The water supplied to the pipes 40 and 42 is pressurized and, in most residential settings, varies between about 30 psi and 65 psi. The hot and cold water pipes 40, 42 respectively have manually operable valves 44, 46 connected therein. In conventional installations, the downstream sides of the valves 44, 46 would directly supply the bathtub discharge spout 48 and shower head 50. However, in the exemplary plumbing installation depicted in FIG. 1, the downstream sides of valves 44, 46 instead supply a common outlet pipe 54. The pipe 54 in turn is coupled to the inlet port 60 of a selector and flow control valve 62. The valve 62 is provided with first and second outlet ports 64, 66. Outlet port 64 is coupled via pipe 68 to the bathtub spout 48 and shower head 50 in a substantially conventional manner. That is, the bathtub spout 48 includes a directional valve 70 such that in one position of the valve 70, water supplied via pipe 68 is discharged into the tub via spout 48 and in a second position of the valve 70, water supplied via pipe 68 is diverted to shower head 50.

The selector and flow control valve 62 (depicted in FIGS. 11 and 12) functions to direct water supplied to inlet port 60 to either outlet port 64 or outlet port 66. In addition to selecting the active outlet port, i.e. 64 or 66, the valve 62 enables a user to control the volume of the flow directed to the active outlet port.

Outlet port 66 is connected through an in-line screen filter and an antisiphon valve 74 to a manifold pipe 76. The aforementioned hydrotherapy units 30, 32 and any additional hydrotherapy units, not shown, are supplied with pressurized tap water from water manifold pipe 76. The purpose of the screen filter is to prevent small debris from reaching the hydrotherapy units and the purpose of the antisiphon valve is to prevent the possibility of tub water back flow to pipe 54 in the event of a sudden drop in the tap water supply pressure.

The plumbing installation depicted in FIG. 1 additionally includes a manually operable air control valve 80 which enables a user to vary an opening 81 at the end of air tube 82. Air tube 82 is coupled by an air manifold pipe 84 to the aforementioned hydrotherapy units 32, 30 and any additional units, not shown. In addition to the foregoing, the water tub 20 is provided with an overflow drain port 86 which functions to define the upper surface level of the water pool 26. The opening at the end of air pipe 82 is located vertically above the level of drain port 86.

Prior to providing a detailed explanation of the structure of the preferred hydrotherapy unit embodiments 30, 32, it would be helpful if the reader understood the purpose and operation of the system depicted in FIG. 1. Basically, the system of FIG. 1 incorporates hydrotherapy units within an otherwise essentially conventional bathtub plumbing system and utilizes the available pressurized tap water supply to operate the units, without requiring an electrically driven pump. To understand the operation, initially, consider the valve 62 to be in the position such that it couples inlet port 60 to outlet port 64. When valve 62 is so positioned, the tub 20 can be operated in a conventional manner with the hot and cold water provided through valves 44 and 46 being directed either to shower head 50 or bathtub spout 48, depending upon the position of directional valve 70. Prior to using the hydrotherapy units 30, 32 the user would initially fill the tub 20 to accumulate the water pool 26. With the tub so filled, the user will then operate the valve 62 to couple inlet port 60 to outlet port 66 to thereby supply pressurized water to hydrotherapy massage units 30, 32 via water manifold pipe 76. The temperature of the water supplied to the units 30, 32 is controlled by the valves 44 and 46. The maximum quantity of water discharged from port 66 is also determined by the valves 44, 46, but may be reduced more conveniently by the flow control valve 62.

As will be seen hereinafter, the tap water flow supplied to the hydrotherapy units 30, 32 is used to aspirate water from the tub water pool 26 to discharge a stream into the tub comprised of both a fresh tap water constituent and a recirculated tub water constituent. In addition, the stream may include an air constituent entrained in the water flow, dependent upon the opening defined by the air control valve 80. The temperature of the stream discharged from the hydrotherapy units 30, 32 is dependent upon the temperature of the tap water supplied to the valve 62 via pipe 54. By properly setting the valves 44, 46 the user can maintain the temperature of the water pool at a desired level and avoid the cooling that would otherwise be experienced by recirculating tub water and introducing air. As will be discussed hereinafter, the water stream discharged from the units 30, 32 into the water pool 26 will be comprised of about 25 percent fresh tap water and 75 percent recirculated tub water. The excess water introduced into the tub will of course flow out of the overflow drain port 86.

Figure 2:
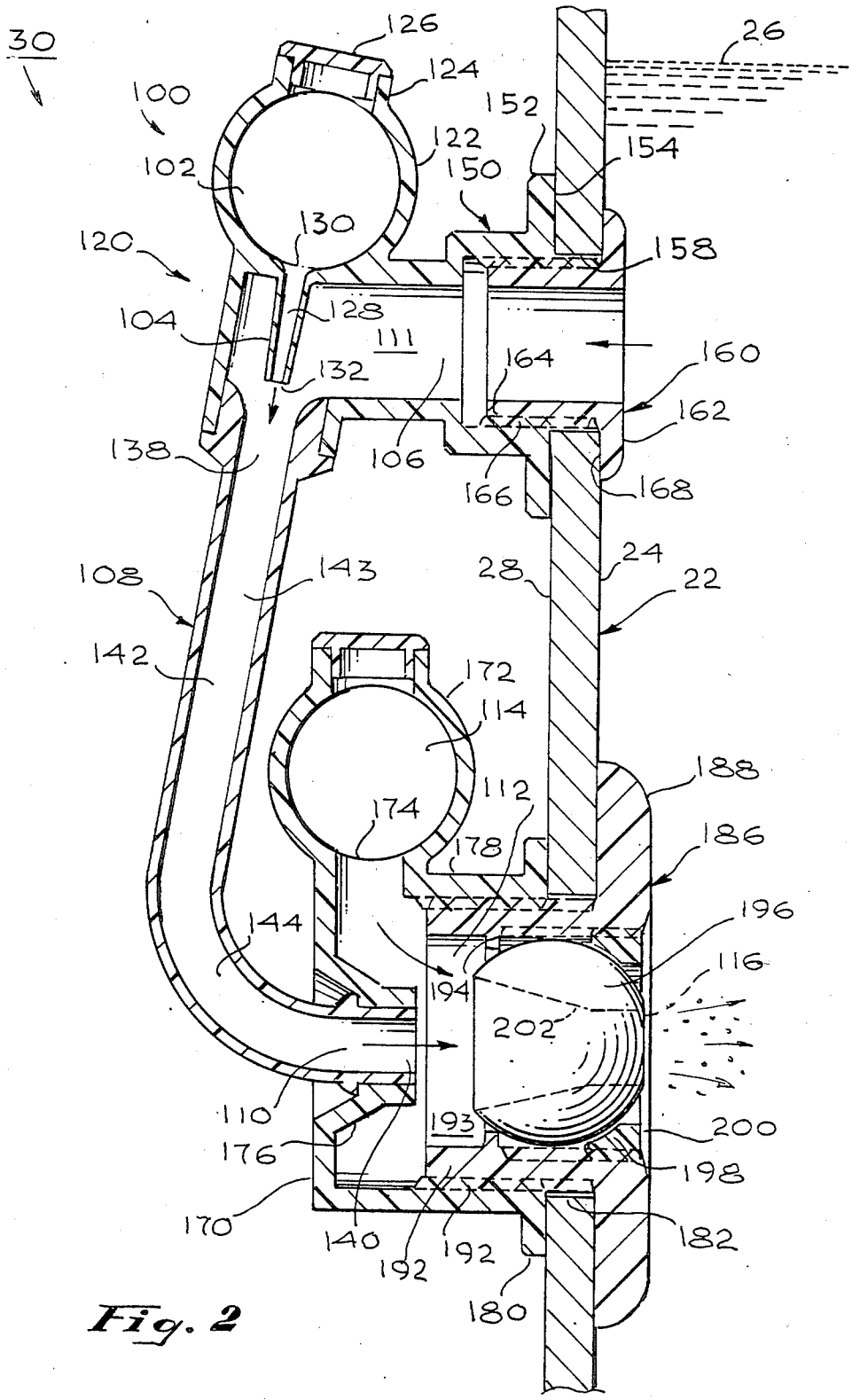
FIG. 2 is a vertical sectional view taken substantially along the plane 2—2 of FIG. 1 showing a fixed nozzle hydrotherapy unit in accordance with the present invention.

Attention is now directed to FIG. 2 which illustrates a sectional view of the fixed discharge nozzle hydrotherapy unit 30 previously mentioned in connection with FIG. 1. The unit 30 is basically comprised of a jet pump means 100 generally including a supply inlet 102, a driving nozzle 104, a suction inlet 106, an elongated mixing tube 108, and a discharge outlet 110. Fresh tap water supplied to the inlet 102 flows under pressure through the driving nozzle 104 creating a low pressure region in suction chamber 111 to thus aspirate tub water available at the suction inlet 106. The combined tap water-tub water flow is then directed through mixing tube 108 to the discharge outlet 110 and into a second suction chamber 112. Air drawn into the mixing chamber 112 via inlet 114 is entrained in the water flow out of discharge outlet 110 and supplied to a discharge nozzle orifice 116.

Now considering the unit 30 in greater detail, it is pointed out that it is comprised of parts which are preferably fabricated of plastic material which can be injection molded, e.g., PVC or ABS. The unit 30 is preferably designed so that it can be readily assembled of a minimum number of low cost injection molded parts, as by threading or cementing the parts together. The detailed fabrication of the unit 30 is of course subject to many variations and, in large part, is dictated by fabrication cost considerations. Thus, it should be understood that the particular implementation illustrated in FIG. 2, and for that matter all of the detailed implementations illustrated in this application, are intended to be exemplary only. Having said that, it is pointed out that the unit 30 includes a first part 120 including a pipe section 122 which defines the aforementioned first supply inlet 102. The pipe section 122 is intended to be connected, as depicted in FIG. 1, in the water manifold pipe 76 to permit straight through flow therethrough. The part 120 also defines the driving nozzle 104 which includes a converging internal bore 128 extending from a nozzle entrance opening 130 to an exit opening 132. The diameter of the internal bore 128 tapers downwardly from the opening 130 to the opening 132.

A second part comprising an elongated mixing tube 108 is mounted proximate to the exit opening 132 of nozzle 104. The mixing tube 108 has an open first end 138, defined by a smoothly contoured throat entrance, and an open second end 140. The tube 108 defines an internal bore 142 which is preferably of uniform diameter, including a straight upstream portion 143 and a curved downstream portion 144. The tap and tub water constituents are mixed primarily in straight portion 143. Tube portion 144 is curved primarily to minimize the amount of space required to mount the unit behind peripheral wall 22.

Part 120 includes a laterally projecting nipple 150 having an internal bore defining the aforementioned suction inlet 106. Additionally, the nipple 150 has a flange 152 defining a front face 154 intended to be flush mounted against the rear surface 28 of the tub peripheral wall 22. The flange 152 is held against the rear surface 28 of wall 22 by an apertured fitting 160 which includes a flange 162 and a rearwardly projecting boss 164. The external surface of the boss 164 extends coaxially into the internal bore defined by nipple 150 and is fastened thereto, as by threads or adhesive 166. The rear face 168 of flange 162 bears against the front surface 24 of wall 22 and thus the wall 22 is sandwiched between nipple flange 152 and fitting flange 162. The suction inlet or port 106 communicates with the open first end 138 of mixing tube 108 proximate to the exit opening of nozzle 104. The tap water discharged from the driving nozzle 104 produces a low pressure region in suction chamber 111 to thereby draw tub water through the internal bores of fitting 160 and nipple 150 into the suction inlet 106. The aspirated tub water is thus entrained in the fresh tap water and mixed in tube 108 prior to being discharged through orifice 116.

The downstream end 140 of tube 108 is coupled to a third part 170. The part 170 defines the aforementioned second suction chamber 112. The part 170 also includes a pipe section 172 defining the aforementioned air inlet. The pipe section 172 is similar to the aforementioned pipe section 122 and is intended to be connected to the air manifold pipe 84 as is depicted in FIG. 1. The pipe section 172 defines an opening 174 which communicates with the chamber 112. The tube second end 140 is mounted in a fitting 176 on part 170 so as to supply the combined water flow exiting from the tube 108 into the chamber 112. The flow into the chamber 112 produces a suction to pull air from the pipe section 172 via the opening 174. The part 170 includes a forwardly projecting nipple 178 which has a flange 180 intended to be mounted flush against the rear surface 28 of peripheral wall 22. The internal bore of nipple 178 is mounted substantially coaxially with an opening 182 formed in the peripheral wall 22. More specifically, a fitting 186 is provided having a flange 188 and a rearwardly projecting boss 190 intended to project into and be fastened, as by threading, in the internal bore of nipple 178, as at 192. Thus, the peripheral wall 22 will be tightly sandwiched between the flange 180 of part 170 and the flange 188 of fitting 186.

The fitting 186 defines a central bore 193 for accommodating a swivel element 196 outwardly of an internal flange 194. The swivel element 196 defines a spherical surface intended to seat against arcuate surface 198 defined by an inwardly projecting ring 200, which is preferably threaded into fitting 186. The swivel element 196 defines an internal flow passage 202 for passing the water-air stream from the chamber 112 to orifice 116. The water flow discharged from the tube 108 through the chamber 112 seats the ball against the arcuate surface 198 and flows through the passage 202 of swivel element 196. By manual manipulation of the element 196, the direction of flow discharged from the orifice 116 can be varied to suit the user.

The hydrotherapy unit 30 of FIG. 2 is preferably designed to aspirate the maximum amount of tub water for the minimum amount of supplied tap water. In order to accomplish this, it has been determined that the diameter of the exit opening of the driving nozzle 104 should be approximately one third the internal diameter of the mixing tube 108. In one typical configuration, the uniform internal diameter of the tube was selected to be $\frac{3}{8}$ of an inch. The length of the mixing tube straight portion is preferably 4–7 times the internal diameter of tube 108.

It should be noted in FIG. 2 that the tub water inlet is located vertically above the water-air stream discharge orifice 116. This is important to minimize water splashing out of the tub 20. That is, as long as the level of the water pool 26 is vertically above the level of the tub water inlet 106, the stream discharged from the orifice 116 element 196 will be below the surface of the water pool. If the water pool level falls below the level of the suction inlet 106, then, of course, no tub water will be entrained in the fresh tap water flow discharged by driving nozzle 104. The tap water flow alone discharged from orifice 116, i.e., without being combined with aspirated tub water, will be insufficient to produce significant splashing out of the tub.

Attention is now directed to FIGS. 3–10 which illustrate an exemplary construction of the moving nozzle hydrotherapy unit 32 depicted in FIG. 1, which it will be recognized, is similar to the embodiment of FIGS. 18–24 of applicant's aforementioned application Ser. No. 796,987. It should be understood, however, that the unit 32 depicted in FIG. 1 is exemplary only and that numerous other units, e.g., any of the embodiments disclosed in applicants aforementioned applications, could be readily adapted for use in accordance with the present invention. More specifically, the embodiment of FIGS. 18–24 of application Ser. No. 796,987 has been adapted, as depicted in FIG. 1 herein, to incorporate a jet pump means, substantially identical to the jet pump means 100 depicted in FIG. 2 of this application.

Figure 3:
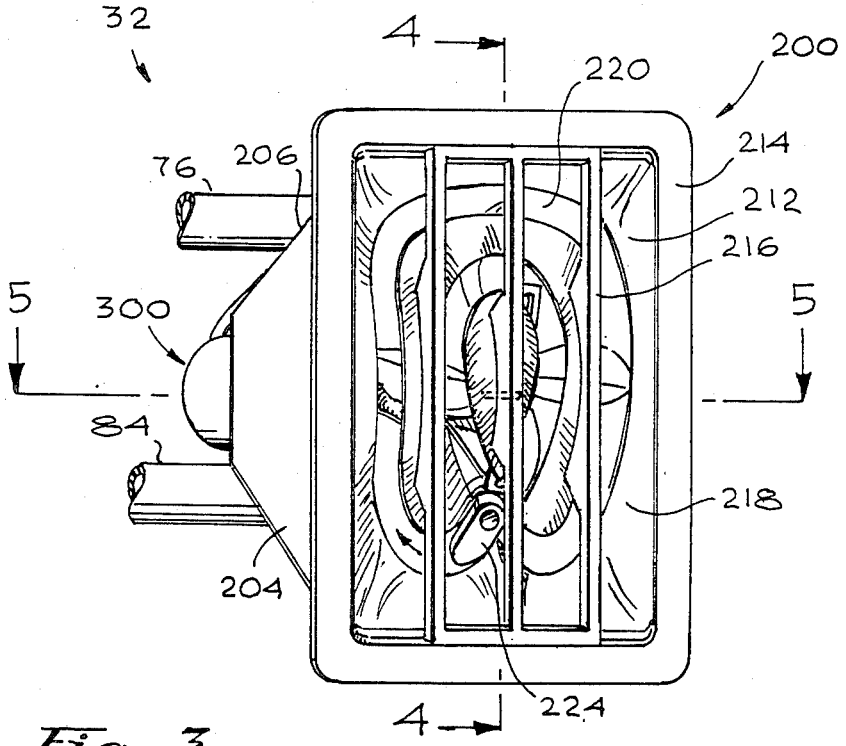
FIG. 3 is an isometric front view of the moving nozzle hydrotherapy unit of FIG. 1.
Figure 4:
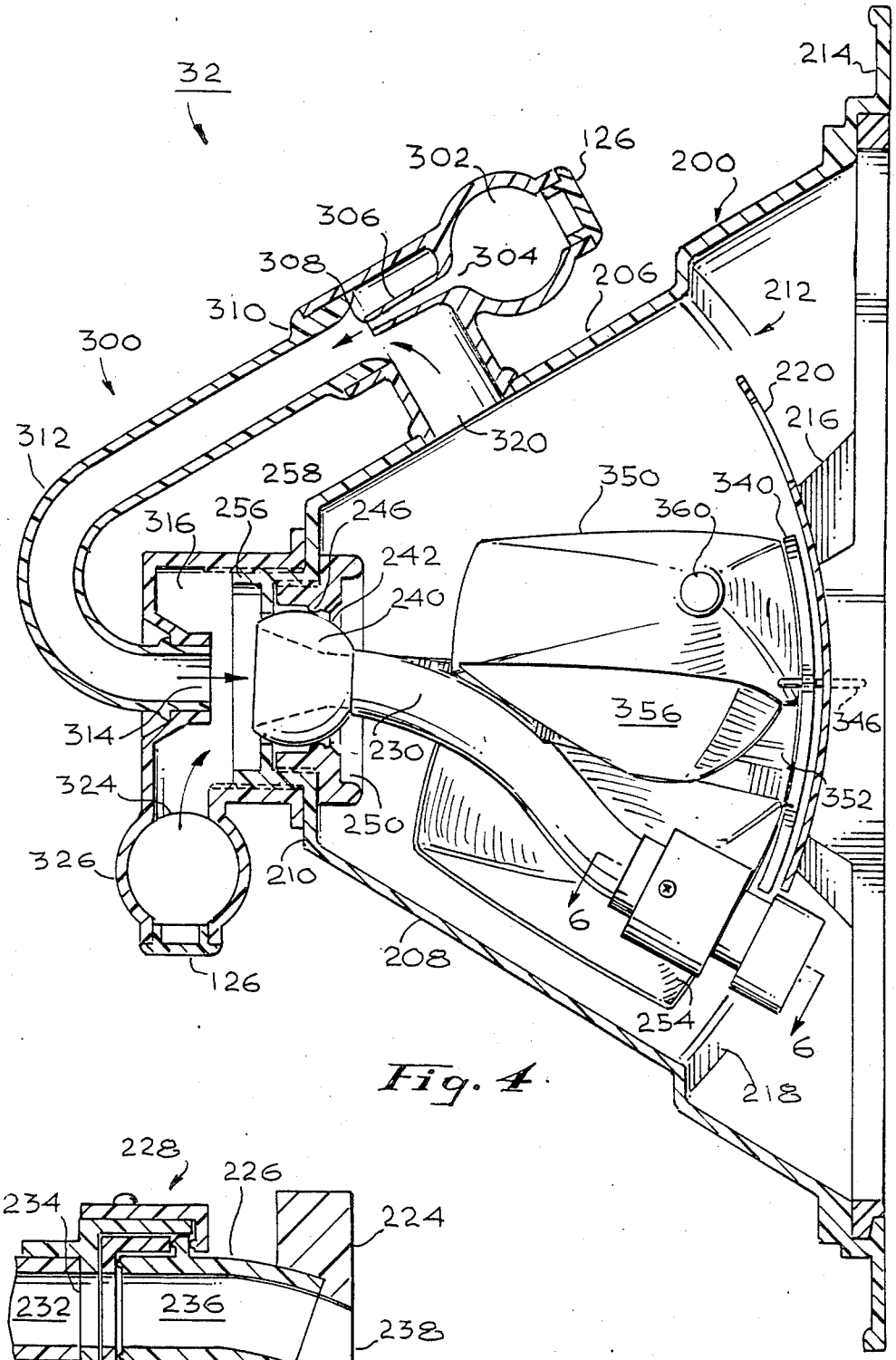
FIG. 4 is a vertical sectional view taken substantially along the plane 4—4 of FIG. 3.
Figure 6:
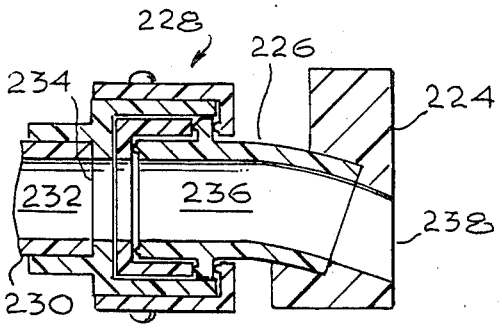
FIG. 6 is a sectional view taken substantially along the plane 6—6 of FIG. 4.
Figure 5:
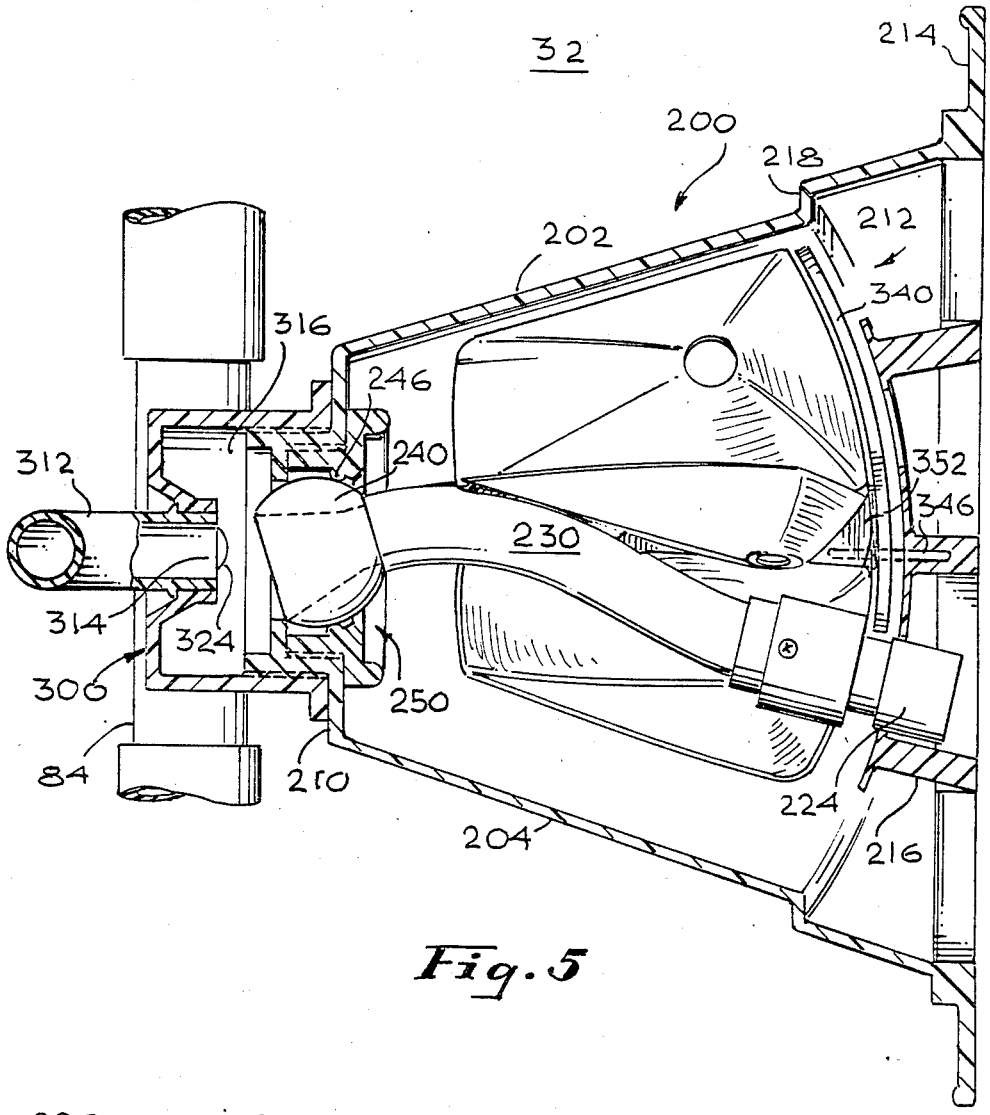
FIG. 5 is a horizontal sectional view taken substantially along the plane 5—5 of FIG. 3.

Directing attention to FIGS. 3, 4, 5, the unit 32 can be seen to comprise a housing 200 having side walls 202, 204, a top wall 206, a bottom wall 208, a rear wall 210, and an open front window area 212 surrounded by frame 214. The housing is intended to be mounted in an opening in the tub peripheral wall as depicted in FIG. 1 with the frame bearing against the wall inner surface. A front grill 216 is provided for mounting within the frame 214. The grill 216 cooperates with housing wall portions 218 to form a guide slot 220 defining a nozzle travel path. A nozzle means comprised of a slide member 224 and nozzle member 226 is supported for translation along the slot 220. The slide member 224 is mounted on the discharge nozzle member 226 which is supported, by rotational coupler 228, on the end of a rigid conduit tube 230 (FIG. 6).

The rigid conduit tube 230 defines a central passageway 232 open at its free end 234 for communicating with the passage 236 through nozzle member 226 and the passage 238 through slide member 224. It is pointed out that the passage 236 includes a curve or bend which directs the stream discharged therefrom in a direction having a primary massage component extending substantially along the elongation of the tube 30 substantially perpendicular to the tub peripheral wall 22 and a secondary thrust component extending substantially parallel to the peripheral wall 22. The supply end of the rigid tube 230 carries a swivel element 240 having a spherical surface 242 formed thereon. The element 240 is mounted for swivel movement within a socket defined by ring 246 of fitting 250. The fitting 250 is mounted on the housing 200 in alignment with an opening in the rear housing wall 210. More specifically, the housing rear wall defines a central opening surrounded by an internally threaded rearwardly projecting wall 256. The fitting 250 carries external threads which are threaded into the internally threaded wall 250 at 258.

A jet pump means 300 is mounted proximate the exterior wall surfaces of the housing 200 to supply a water-air stream to the central bore through swivel element 240 and thence through the tube 230 for discharge through the nozzle member 226. The jet pump means 300 is substantially identical to the jet pump means 100 previously discussed in connection with FIG. 2. Briefly, the jet pump means 300 includes a supply inlet 302 which communicates with the entrance opening 304 of a driving nozzle 306 having an exit opening 308. The nozzle 306 communicates with the open first end of an elongated mixing tube 312. The downstream second end 314 of the mixing tube opens into a suction chamber 316 which discharges into the bore of the aforementioned swivel element 240. The jet pump means 300 includes a suction inlet 320 which opens to the tub water through the housing wall 206. Thus, as fresh tap water is discharged through the nozzle 306 to the exit opening 308, it will create a low pressure region to thereby aspirate tub water through the suction inlet 320 for flow through the mixing tube 312. The combined flow through the tube 312, comprised of both fresh tap water and recirculated tub water constituents, is discharged into the chamber 316. The water flow discharged into the chamber 316 creates a low pressure region to pull air into the chamber 316 via air inlet 324 from air pipe 326. The air pipe 326 in FIGS. 1 and 4 has, for clarity, been depicted, as being vertically below the downstream end 314 of mixing tube 312. With this geometry, water could collect in air manifold pipe 84 between units 32 and 30 when the units are deactivated. In order to prevent such water collection, it is preferable to mount unit 30 at a level such that pipe 84 slopes slightly downward from unit 32 to unit 30 to drain pipe 84 out through chamber 112 of unit 30. Alternatively, of course, unit 32, can be configured so that air opening 324 is vertically above chamber 316, similiarly to how unit 30 is depicted in FIG. 2.

The water-air stream discharged into the bore of element 240 essentially seats the ball against the ring surface 246 and prevents leakage therepast. By proper choice of materials, the ball 240 is nevertheless able to freely rotate with respect to the surface 246. The water-air stream discharged into the bore of element 240 flows through the central passage 232 of tube 230 to the nozzle member 226. The tube 230 is preferably curved along its length to facilitate smooth flow therethrough for all possible orientations of the tube relative to the axis of the water-air stream entering through the bore of element 240. That is, it is desirable that the tube 230 be constructed so as to minimize the pressure drops which might occur in the stream upon entry into and flow along the tube. To facilitate smooth flow of the stream through the tube 230, the curved sections thereof preferably lie in substantially a single plane and the planar orientation of the tube is at all times maintained substantially radial to the axis of the water-air stream discharged from the end 314 of tube 312. That is, as the nozzle member 226 translates along the guide path 220, the plane of tube 230 is adjusted to maintain it substantially radial to the axis of tube end 314 with the substantially straight entrance section of tube 230 not deviating by more than about 160 from the axis of tube end 314.

Figure 7:
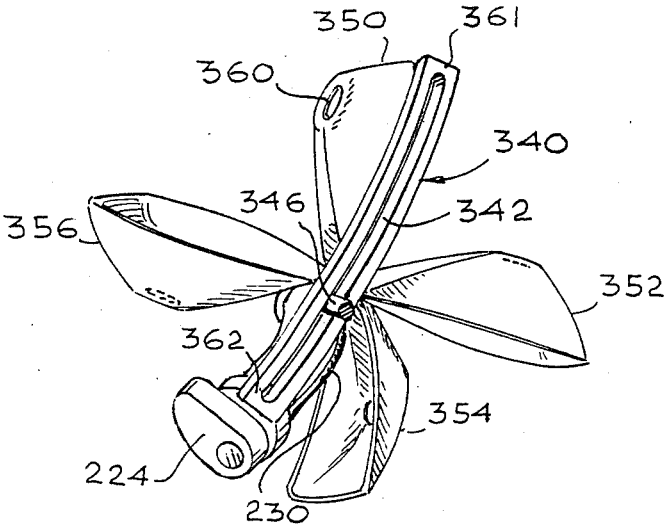
FIG. 7 is an isometric view primarily depicting the moving nozzle mechanism, including speed sensitive drag means, of the hydrotherapy unit of FIG. 3.

In order to maintain this radial orientation of the plane of tube 230, an arm 340 having a slot 342 therein is mounted for movement on a pin 346 projecting rearwardly from the grill 216. The pin 346 is mounted in alignment with the end 314 of tube 312 and because of this relationship, the arm 340 will always extend in a substantially radial direction from the pin 346. In order to assure that the plane of the tube 230 also extends substantially radial to the pin 346 (and thus radial to the axis of tube end 314), the arm 340 and tube 230 are structurally fixed to one another. This is accomplished, as is best shown in FIGS. 4, 5 and 7, in conjunction with the provision of apertured cupped plates 350, 352, 354, and 356 which are secured to the tube 230 in a substantially cruciform fashion. Each of the cupped plates includes an aperture 360 therein so that they act as sea anchors to introduce drag and slow the movement of the tube 230, and thus the nozzle member 226, through the water. The slotted arm 340 is secured to the forward edge of cupped plate 352 which in turn is secured to the tube 230. Thus, the plane of tube 230 will be fixed with respect to the elongation of arm 340 which in turn will be maintained in orientations radial to the fixed pin 346.

Figure 8:
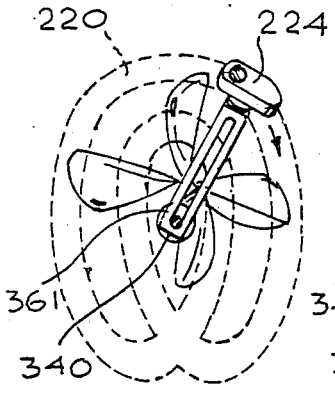
FIGS. 8, 9 and 10 schematically depict different orientation of the moving nozzle mechanism of FIG. 7 as it traverses its travel path.
Figure 9:
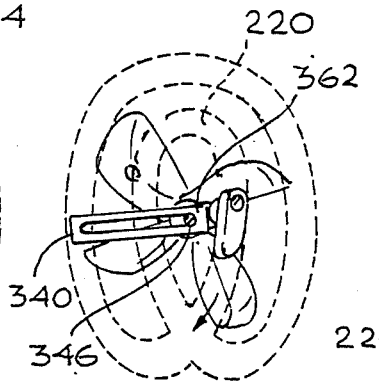
Figure 10:
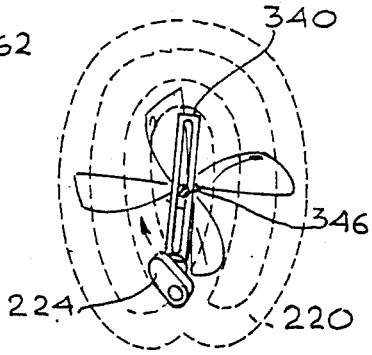

FIGS. 8, 9, and 10 schematically depict the movement of the slotted arm 340 with respect to the pin 346 for various positions of the nozzle member along the guide path 220. Note for example in FIG. 8 when the slide member 244 is at the one o'clock position in the outer loop of the guide path, the arm 340 moves to a position where the pin 346 is very close to the free end 361 of the arm. Note in FIG. 9 when the slide member is essentially at the three o'clock position on the inner loop of the guide path 220, the arm 340 moves to a position where the pin 346 is at the inner end 362 of the arm 340. FIG. 10 depicts the slide member 224 moving from the outer loop of the guide path 220 to the inner loop, at substantially a six o'clock position, and shows the pin 346 substantially intermediate the ends 360 and 362 of the arm 340.

It should be noted in FIGS. 8, 9, and 10 that the nozzle member continually moves in a clockwise direction, as depicted by the arrows along the guide slot. With this motion, the swivel element 240 tends to continually turn clockwise within the fitting 250. Thus, any friction between the surface of the element 240 and the socket surface 246 of the fitting 250 will tend to tighten the threaded coupling between the fitting and the rearwardly extending pipe section 256 of housing 200. It should also be noted that the cupped plates 350, 352, 354 and 356 have been shown slightly exaggerated for clarity. In actuality, of course, it is essential that they be dimensioned so as to be accommodated within the housing 200 without contacting the housing wall for all positions of the nozzle means along the guide path.

As previously pointed out, the design of hydrotherapy unit 32 can take many different forms, several of which are disclosed in applicant's aforementioned applications. Although not essential to the invention, it is preferred that the discharge nozzle of hydrotherapy unit 32 be able to traverse a two dimensional area whose horizontal and vertical dimensions are of the same order of magnitude (e.g. vertical:horizontal $<4:1$). Typical dimensions for bathtub applications are 3–12 inches vertical and 3–8 inches horizontal. For other spas and tubs, the preferred dimensions are typically greater.

Figure 11A:
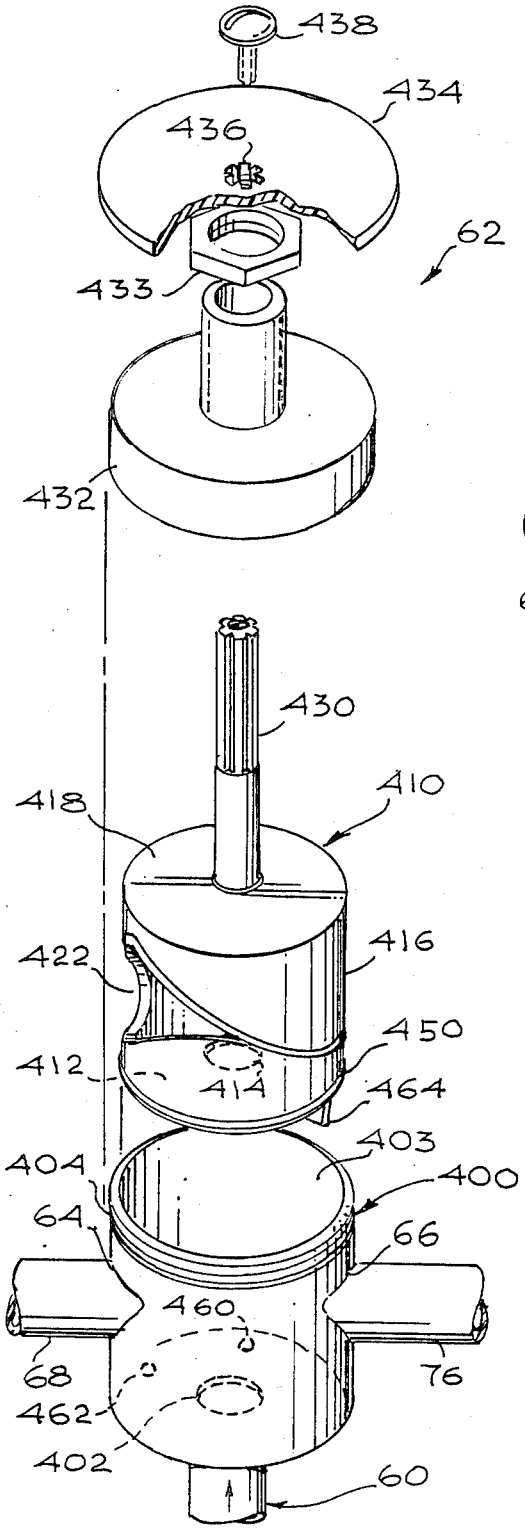
FIG. 11A is an exploded isometric view depicting an exemplary selector/flow control valve useful in the system of FIG. 1
Figure 11B:
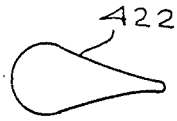
FIG. 11B illustrates the shape of a flow control opening used therein.

Attention is now directed to FIGS. 11 and 12 which illustrate a preferred embodiment of a selector and flow control valve 62 suitable for use in the system depicted in FIG. 1. Basically, it will be recalled that the purpose of the valve 62 is to direct the water flow from pipe 60 either to the bathtub spout via pipe 68 or to the hydrotherapy units 30, 32 via manifold pipe 76.

The valve 62 includes a cylindrical cup-shape housing 400. The housing 400 defines a supply opening 402 in the bottom wall thereof which is coupled to the water inlet pipe 60. The cylindrical wall of the housing 400 defines a first port 64 coupled to pipe 68 and a second port 66 coupled to pipe 76. The upper end 403 of the housing 400 is open and the upper portion of the housing cylindrical wall is externally threaded at 404.

A substantially cylindrically shaped valve body 410 is provided for nesting within the cylindrical cavity defined by the cup shaped housing 400. The valve body 410 includes a floor member 412 defining a central opening 414 aligned with the supply opening 402 in the housing 400. Valve body 410 additionally includes a cylindrical sidewall 416 and a closed cover 418. Thus, the floor member 412, the cover 418, and the cylindrical wall 416 define an internal cavity which is supplied by water from pipe 60 via central opening 414. The cylindrical sidewall 416 has a flow control opening 422 formed therein adapted to selectively communicate with either port 64 or port 66 as the valve body 410 is rotated within the housing 400. The opening 422 is tapered, e.g., in the shape of a horizontal tear drop (FIG. 11B), so as to enable the degree of communication between the opening 414 and port 66 to be varied depending upon the rotational position of the body 410.

A splined stem 430 extends upwardly from the cover 418 and is intended to extend through a central opening in lid 432. Lid 432 is internally threaded and intended to be engaged with the threads 404 on housing 400. An externally threaded nipple extends from the lid 432 for receiving nut 433 for mounting the valve 62 to the tub wall. A handle 434 is apertured at 436 to enable the handle to fit on the splined end of stem 430. A screw 438 is provided to secure the handle 434 to the end of the stem 430.

The tear drop opening 422 defined in the cylindrical wall 416 of valve body 410 is preferably surrounded by sealing material, e.g. O-ring, 450 to prevent leakage along the exterior surface of the valve body cylindrical wall 416. The sealing material 450 seals against the interior wall of valve housing 400.

Figure 12A:
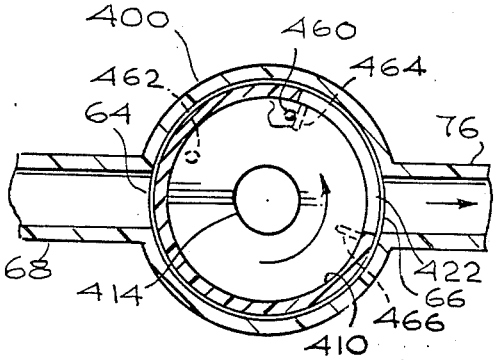
FIGS. 12A, 12B, and 12C schematically depict different settings of the selector/flow control valve of FIG. 11A.
Figure 12B:
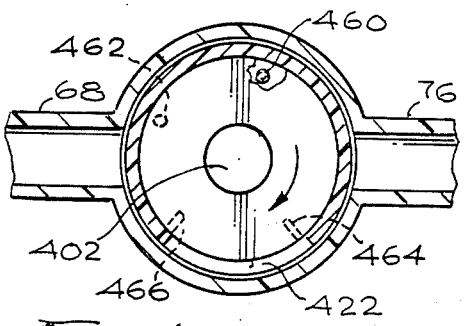
Figure 12C:
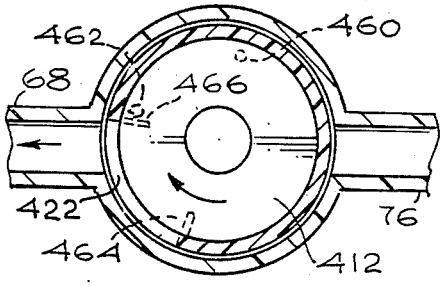

In the use of the valve 62, the user can selectively rotate the valve body 410 to either close both ports 64 and 66 or selectively open either port by aligning the opening 422 with it. FIG. 12A shows the valve body 410 positioned to supply tap water flow to the hydrotherapy units. FIG. 12B shows both ports 64 and 66 closed. FIG. 12C shows the valve body rotated to open port 64 to the bathtub spout. It is preferable to incorporate stop members on the valve body 410 and housing 400 to limit the rotation of the body member 410 to facilitate control by the user. Thus, fixed stop members 460 and 462 are mounted to the interior bottom surface of housing 400. Additionally, stop members 464 and 466 depend from the bottom surface of valve body floor member 412 for engaging the stop members 460 and 462.

Note in FIG. 12A that the valve body has been rotated to its maximum counterclockwise position in which stop member 464 engages stop member 460. In this position, the maximum area of opening 422 is aligned with port 66 to thereby provide a maximum flow to the hydrotherapy units. By moving the valve body clockwise from the position depicted in FIG. 12A, the flow to the hydrotherapy units will gradually diminish as the area of opening 422 overlapping port 66 decreases. Note in FIG. 12B that no portion of valve body opening 422 is aligned with either port 64 or 66. As the valve body rotates further in a clockwise direction, the opening 422 moves into alignment with port 64 to direct the water flow to the bathtub spout 48.

In typical use, the user will fill the tube with the valve as depicted in FIG. 12C. He will then shut the flow off by rotating the valve to the orientation of FIG. 12B. He will then immerse himself and be able to initiate and control the flow to the hydrotherapy units by rotating the valve toward the orientation of FIG. 12A. Although the opening 422 is depicted as being tapered toward only one end to vary the flow out of port 66, it should be recognized that, if desired, the other end of opening 422 can also be tapered to vary the flow out of port 64 as well.

From the foregoing it should now be appreciated that a hydrotherapy apparatus and method of operation has been disclosed herein characterized primarily by the use of available pressurized tap water for powering hydrotherapy units. More particularly, in accordance with the invention, energy is extracted from the available pressurized tap water to aspirate tub water and mix it with fresh tap water to discharge a water stream into the tub for massaging a user. The energy derived from the tap water is also used to entrain air in the discharged water stream to facilitate massaging. In the disclosed preferred embodiment, a jet pump is incorporated in each hydrotherapy unit mounted on the peripheral wall of a water tub for aspirating and recirculating the tub water. In accordance with a further significant aspect of the invention, energy derived from the supplied tap water is also used to move a discharge nozzle along a path substantially perpendicular to the water - air stream being discharged. By using the tap water to supply energy both for recirculating the tub water and/or moving the discharge nozzle, embodiments of the invention can be installed and operated at a significantly lower cost than prior art hydrotherapy systems. Although particular embodiments of the invention have been described and illustrated in detail, it is recognized that various modifications and alternatives may readily occur to those skilled in the art and it is intended that the claims be interpreted to cover such modifications, alternatives, and other equivalents.

We claim:

1. In combination with a tap water source means supplying a pressurized fresh water flow, hydrotherapy apparatus operable with an electrically driven pump for discharging a water stream for massaging a user's body, said apparatus comprising:

a tub having a peripheral wall for containing a water pool;

a discharge means for discharging a water stream into said pool;

means mounting said discharge means proximate to an area of said peripheral wall for movement along a path extending substantially perpendicular to said stream; and means responsive to said pressurized fresh water flow for moving said discharge means along said path.

2. The combination of claim 1 further including means for mixing water from said pool with said supplied fresh water flow to produce said water stream.

3. The combination of claim 2 further including means for entraining air in said water stream prior to being discharged into said pool.

4. The combination of claim 2 wherein said means for mixing pool water and fresh water includes a jet pump having a supply inlet and a suction inlet;

means for communicating said suction inlet with said pool; and means for supplying said fresh water flow to said supply inlet for aspirating pool water through said suction inlet.

5. The combination of claim 1 wherein said means for moving said discharge means includes means for directing said discharged stream in a direction having a primary component extending substantially perpendicular to said wall area and a secondary component extending substantially parallel to said wall area, said secondary component producing a thrust force for moving said discharge means along said path.

6. The combination of claim 4 further including: an overflow drain port formed in said peripheral wall to define a pool water level; and wherein said jet pump suction inlet is located vertically below said drain port.

7. The combination of claim 4 wherein said jet pump further includes a discharge outlet for supplying said water stream to said discharge means; and wherein said discharge means path of movement is vertically below said suction inlet.

8. The combination of claim 4 including a bathtub spout; and selector valve means for selectively directing said fresh water flow either to said spout or to said jet pump supply inlet.

9. The combination of claim 4 further including manually adjustable means for controlling the fresh water flow to said jet pump supply inlet.

10. The combination of claim 4 further including anti-siphon valve means for preventing water flow from said jet pump to said tap water source.

11. The combination of claim 1 including means for entraining air in said water stream discharge from said discharge means.

12. In combination with a tap water source means supplying a pressurized fresh water flow, hydrotherapy apparatus operable with an electrically driven pump for discharging a water stream while concurrently moving said stream for massaging a user's body, said apparatus comprising:

a tub having a peripheral wall for containing a water pool;

a water discharge means mounted proximate to an area of said wall for movement along a travel path oriented substantially parallel to said wall area;

said water discharge means including an orifice oriented to discharge said water stream into said tub having primary component extending substantially perpendicular to said wall area and a secondary component extending substantially parallel to said wall area, said secondary component producing a thrust force for moving said discharge means along said travel path;

jet pump means including a supply inlet, a suction inlet and a discharge outlet for responding to a first pressurized fluid coupled to said supply inlet for entraining a second fluid coupled to said suction inlet for discharging a combined flow at said discharge outlet comprised of a first fluid constituent and a second fluid constituent;

means for coupling said supply inlet to a source of tap water;

means for coupling said suction inlet to the water pool in said tub; and means for coupling said discharge outlet to said water discharge means.

13. The combination of claim 12 including means for entraining air in said combined flow.

14. The combination of claim 12 wherein said second fluid constituent is larger than said first fluid constituent.

15. The combination of claim 12 wherein said jet pump means includes a driving nozzle having an exit opening discharging into an elongated mixing tube and an entrance opening communicating with said supply inlet.

16. The combination of claim 12 including an overflow drain port mounted in said tub; and wherein said means for coupling said suction inlet to said water pool includes a suction port mounted in said tub vertically below said overflow drain port.

17. The combination of claim 16 wherein said suction port is vertically above said discharge means path of movement.

18. The combination of claim 16 including means for entraining air in said combined flow comprising an air tube having an entrance port open at a level vertically above said overflow drain port.

19. The combination of claim 12 including a second discharge means;

a second jet pump means including a supply inlet, a suction inlet and a discharge outlet for responding to a first pressurized fluid coupled to said supply inlet for aspirating a second fluid coupled to said suction inlet for discharging a combined flow comprised of first and second fluid components at said discharge outlet;

means for coupling said second jet pump means supply inlet to said source of tap water;

means for coupling said second jet pump means suction inlet to the water pool in said tub; and means for coupling said second jet pump means discharge outlet to said second discharge means.

20. The combination of claim 12 wherein said travel path defines an area having perpendicular first and second dimensions having a ratio of less than 4:1.

21. The combination of claim 12 wherein said water discharge means includes a conduit having (1) a supply end and (2) a discharge end defining said orifice.

22. The combination of claim 21 wherein said conduit comprises an elongated rigid tube; and means mounting the supply end of said rigid tube for swivel movement to enable said discharge end to move along said travel path.

23. The apparatus of claim 12 including an opening in said wall coincident with said wall area;

a housing projecting rearwardly from said opening comprising a housing wall including a rear wall portion oriented substantially parallel to a projection of said peripheral wall in said opening; and wherein said water discharge means includes an elongated tube having (1) a supply end mounted proximate to said rear wall portion and (2) a discharge end defining said orifice mounted for movement in said opening along said travel path.

24. The apparatus of claim 23 wherein said elongated tube is rigid and includes means on the supply end thereof mounting said tube for swivel movement with respect to said rear wall portion.

25. The apparatus of claim 23 wherein said means for coupling said suction inlet to said water pool includes a suction port formed in said housing wall.

26. The apparatus of claim 25 including a drain port formed in said tub peripheral wall for establishing the level of said water pool; and wherein said suction port is located vertically below said drain port.

27. The combination of claim 26 wherein said suction port is vertically above said discharge means path of movement.

28. The apparatus of claim 23 wherein said jet pump means includes a converging nozzle having an entrance opening communicating with said supply inlet and an exit opening communicating with an upstream end of a mixing tube; and wherein said suction inlet also communicates with said upstream end of said mixing tube.

29. The apparatus of claim 28 including a curved elongated pipe section coupled to the downstream end of said mixing tube.

30. The apparatus of claim 29 wherein said means for coupling said suction inlet to said water pool includes a suction port formed in said housing wall.

31. The apparatus of claim 30 including means defining a suction chamber;

means coupling the downstream end of said mixing tube to said suction chamber;

means coupling said elongated tube supply end to said suction chamber; and means for coupling an air source to said suction chamber for entraining air in said combined flow supplied to said elongated tube.

32. The apparatus of claim 31 including a drain port formed in said tub peripheral wall for establishing the level of said water pool; and wherein said suction port is located vertically below said drain port.

33. The apparatus of claim 32 wherein said means for coupling an air source includes an air tube having an entrance port open at a level vertically above said drain port.

34. The apparatus of claim 31 wherein said means for coupling an air source to said mixing chamber includes manually operable valve means for varying the air flow to said mixing chamber.

35. The apparatus of claim 12 wherein said means for coupling said supply inlet to a source of tap water includes manually operable valve means for varying the water flow to said supply inlet.

36. Hydrotherapy massage apparatus suitable for installation in a tub having (1) a peripheral wall for containing a water pool and (2) an available source of pressurized water, said apparatus operable without an electrically driven pump comprising:

jet pump means having a supply inlet, a suction inlet, and a discharge outlet for responding to a first pressurized fluid coupled to said supply inlet for aspirating a second fluid coupled to said suction inlet for discharging a combined flow comprised of first fluid and second fluid components at said discharge outlet;

means for coupling said source of pressurized water to said supply inlet;

means for coupling said suction inlet to the water pool in said tub;

a discharge nozzle means mounted proximate to an area of said wall for movement along a travel path extending substantially parallel to said wall area; and means coupling said pump means discharge outlet to said discharge nozzle means for supplying said combined flow thereto;

said discharge nozzle means including means for discharging a water stream into said tub having a primary component extending substantially perpendicular to said wall area for impacting against a user's body and a secondary component extending substantially parallel to said wall area for thrusting said discharge nozzle means along said travel path.

37. The apparatus of claim 36 wherein said jet pump means comprises:

a converging nozzle having an entrance opening and an exit opening:

means coupling said converging nozzle entrance opening to said supply inlet:

a mixing tube having an open first end and an open second end; and means mounting said mixing tube first end in close proximity to said converging nozzle exit opening.

38. The apparatus of claim 37 wherein said mixing tube has a substantially uniform internal diameter.

39. The apparatus of claim 38 including a curved flow tube coupling said mixing tube second end to said discharge nozzle means.

40. The apparatus of claim 37 wherein said mixing tube has a diameter substantially larger than the internal diameter of said converging nozzle exit opening.

41. The apparatus of claim 37 wherein the length of said mixing tube is substantially greater than the internal diameter of said mixing tube.

42. The apparatus of claim 37 including means coupling said suction inlet to the open first end of said mixing tube proximate to said convergent nozzle exit opening whereby fresh pressurized water discharged from said exit opening into said mixing tube will draw water from said pool into said mixing tube to produce said combined flow.

43. The apparatus of claim 37 wherein said discharge nozzle means comprises an elongated conduit tube having a supply end and a discharge end;

means mounting said conduit tube with the supply end thereof proximate to said mixing tube second end and with the discharge end thereof free to move along said travel path.

44. The apparatus of claim 41 wherein said travel path defines an area having first and second perpendicular dimensions having a ratio less than 4:1.

45. A hydrotherapy device operable without an electrically driven pump suitable for installation in a water tub for discharging a stream having tap water and recirculated tub water components, said device comprising:

jet pump means including a pump nozzle having an internal bore diminishing in cross-section from an entrance opening to an exit opening of said nozzle;

first inlet means for coupling a source of pressurized tap water to said pump nozzle entrance opening;

an elongated mixing tube member having a first end mounted proximate to, and substantially axially aligned with, said pump nozzle exit opening for receiving tap water exiting therefrom;

second inlet means for coupling tub water to said mixing tube first end proximate to said pump nozzle exit opening for entraining tub water with tap water exiting from said exit opening;

means defining a suction chamber;

means coupling a second end of said mixing tube to said suction chamber for supplying a stream thereto comprised of tap water and tub water components;

means for introducing air into said suction chamber; and a discharge port defined in said suction chamber for discharging a stream therefrom comprised of water and air constituents.

46. The device of claim 45 wherein said mixing tube defines an internal bore having a substantially uniform diameter along its length from said first to said second end.

47. The device of claim 46 wherein said diameter of said mixing tube internal bore is considerably larger than the diameter of said pump nozzle internal bore at said exit opening; and wherein said mixing tube length from said first to said second end is considerably larger than said mixing tube internal bore diameter.

48. The device of claim 47 wherein said mixing tube includes a straight upstream portion and a curved downstream portion.

49. The device of claim 45 wherein said second inlet means for coupling tub water to said mixing tube is spaced from said suction chamber discharge port whereby said device can be installed in said water tub with said second inlet means vertically above said discharge port.

50. The device of claim 45 further including a discharge nozzle; and means mounting said discharge nozzle proximate to said discharge port for variably directing the stream discharged from said discharge port.

51. The device of claim 50 wherein said means mounting said discharge nozzle includes means supporting said discharge nozzle for movement along a travel path oriented substantially perpendicular to said stream discharged from said discharge port.

52. In combination with a bathtub having (1) a peripheral wall for containing a water pool, (2) an overflow drain port formed in said wall to define a pool water level, (3) an available tap water source for supplying a pressurized fresh water flow, and (4) a spout for directing water supplied thereto into said pool, hydrotherapy massage apparatus operable without an electrically driven pump comprising:

a hydrotherapy device including jet pump means having a supply inlet, a suction inlet and a discharge outlet for responding to a first pressurized fluid coupled to said supply inlet for entraining a second fluid coupled to said suction inlet for discharging a combined flow at said discharge outlet comprised of a first fluid constituent and a second fluid constituent;

means mounting said device on said peripheral wall with said suction inlet located vertically below said drain port and said discharge outlet located vertically below said suction inlet; and selector valve means for selectively directing said fresh water flow either to said spout or to said hydrotherapy device supply inlet.

53. The combination of claim 52 further including manually adjustable means for controlling the fresh water flow to said hydrotherapy device supply inlet.

54. The combination of claim 52 further including anti-siphon valve means for preventing water flow from said hydrotherapy device to said tap water source.

55. The combination of claim 52 including means for entraining air in said combined flow discharged at said discharge outlet.

* * * * *

UNITED STATES PATENT AND TRADEMARK OFFICE

CERTIFICATE OF CORRECTION

PATENT NO. : 4,689,839

DATED : September 1, 1987

INVENTOR(S) : Melvyn L. Henkin and Jordan M. Laby

It is certified that error appears in the above—identified patent and that said Letters Patent is hereby corrected as shown below:

Claim 1, line 3, delete "with" and substitute --without--.

Claim 12, line 3, delete "with" and substitute --without--.

Claim 12, line 27, delete "a" and substitute --said--.

Signed and Sealed this

Twenty-ninth Day of March, 1988

*Attest:*

DONALD J. QUIGG

*Attesting Officer*

*Commissioner of Patents and Trademarks*